United States Patent [19]

Lorenz

[11] 4,310,377

[45] Jan. 12, 1982

[54] MACHINE FOR THE MANUFACTURE OF BRUSHES

[75] Inventor: Reinhold Lorenz, Voehl-Oberorke, Fed. Rep. of Germany

[73] Assignee: Schlesinger GmbH & Co. Maschinenbau KG, Frankenberg-Eder, Fed. Rep. of Germany

[21] Appl. No.: 216,733

[22] Filed: Dec. 15, 1980

Related U.S. Application Data

[63] Continuation of Ser. No. 16,136, Feb. 28, 1979, abandoned.

[30] Foreign Application Priority Data

Mar. 2, 1978 [DE] Fed. Rep. of Germany ..... 2808965

[51] Int. Cl.[3] ..... A46D 3/04; A46B 3/00

[52] U.S. Cl. ..... 156/499; 15/159 R; 15/183; 15/192; 15/193; 156/72; 156/556; 156/567; 300/2; 300/21; 428/85

[58] Field of Search ..... 15/159 R, 183, 192, 15/193; 156/72, 499, 556, 567; 300/2, 21; 428/85

[56] References Cited

U.S. PATENT DOCUMENTS

| | | | |
|---|---|---|---|
| 3,596,999 | 8/1971 | Lewis | 300/21 |
| 3,604,043 | 9/1971 | Lewis | 300/21 X |
| 3,910,637 | 10/1975 | Lewis | 300/2 |
| 4,109,965 | 8/1978 | Lewis | 300/21 X |
| 4,255,224 | 3/1981 | Lorenz | 156/499 |

FOREIGN PATENT DOCUMENTS 1114463 10/1961 Fed. Rep. of Germany .

OTHER PUBLICATIONS

"Bonding Brushes Saves Time and Money", Modern Plastics, Jul. 1980, p. 30.

*Primary Examiner*—Edward C. Kimlin
*Assistant Examiner*—Robert A. Dawson
*Attorney, Agent, or Firm*—Blanchard, Flynn, Thiel, Boutell & Tanis

[57] ABSTRACT

A machine for the manufacture of brushes having a bristle collecting station, a melting station, a welding station and at least one bristle bunch holder. The bristle bunch holder consists of a plate having hollow bristle holding sleeves thereon and comprising movement devices, with which the bristle bunch holder is successively aligned with the stations. A discharge station is provided in which ejector means are, during advancement of the bristle bunch holder, pushed through the bristle holding sleeves.

15 Claims, 5 Drawing Figures

MACHINE FOR THE MANUFACTURE OF BRUSHES

This is a continuation of application Ser. No. 16,136, filed Feb. 28, 1979 and now abandoned.

FIELD OF THE INVENTION

The invention relates to a machine for the manufacture of brushes, comprising a bristle collecting station, a melting station, a welding station and at least one bristle bunch holder, which consists of a plate which has bristle holding sleeves thereon and comprising movement devices for effecting a successive alignment of the bristle bunch holder with the stations.

BACKGROUND OF THE INVENTION

Machines of this type are known, for example from U.S. Pat. No. 3,596,999. During a first working cycle the bristle bunch holder is moved toward a bristle magazine, in which bristles which are cut to the desired length are stacked parallel to one another. The bristle holding sleeves penetrate through holes in the magazine wall and collect plural bunches of bristles. After the sleeves are pulled out, the bristle bunch holder is aligned with a melting station, in which the mutually adjacent ends of all bunches are pressed onto a heating plate and melted to simultaneously fasten together these ends. The individual bristles of the bristle bunches melt together. After the melting process, the bristle bunch holder is aligned with a brush head and the melted, still soft ends of the bunches are pressed against the brush head, which consists preferably of a thermoplastic material, whereby a fixed connection between the bristle bunches and the brush head is created. The locations on the brush head to be coupled with the bristles can be melted by heating same prior to a pressing on of the bristle bunches, for example by pressing heated pins thereagainst. This results in a particularly good bond.

In the mentioned U.S. Pat. No. 3,596,999, the various stations are provided on a rectilinearly movable carrier. However, machines are also known which have a step-by-step movable carrier, on which carrier several bristle bunch holders are provided, which are all simultaneously movable radially outwardly. During each such movement, the bristle holding sleeves of a bristle bunch holder project into the stationarily arranged bristle magazine, while at the same time a melting takes place at a different location and a welding of the bristle bunches takes place at a further location. A step-by-step rotatable magazine with several receiving means for the brush heads is provided in the welding station. The magazine moves the brush heads first in front of a melting station, in which a hot plate having pins thereon is pressed against the brush head, in order to melt the brush head to each later fastening point of a bristle bunch. The brush head is thereafter moved by the rotatable magazine in front of the bristle bunch holder, which presses the bunches onto the melted locations on the brush head. In comparison with a rectilinearly movable carrier, the performance in such an arrangement is substantially increased.

It can happen during the production of brushes that the bristle bunches are not orderly welded to a brush head. This can result in a portion or possibly also all bristles remaining in the bristle holding sleeves during a retraction of the bristle bunch holder. If now the bristle bunch holder is again to take bristles from the bristle magazine, further undesirable interference is created, because partially or fully filled bristle holding sleeves are pressed into the bristle magazine. This results in every case in a disorganization in the bristle magazine and thus in a breakdown in the bristle supply. Also bristles can become wedged or jammed in the bristle holding sleeves. To overcome such breakdowns or interference is time-consuming and as a rule is also associated with a loss of bristle material and results finally in a considerable increase in the manufacturing expense.

In the known machine with a rotatable magazine, each brush head receiving means is designated for only one brush head. After leaving the welding station, the finished brush must be manually removed. This requires alone one operator for insertion of bristle heads and for removing the finished brushes so that careful attention must be paid that a brush head which is already provided with bristles does not again move into the welding station, because this would result in an undesirable breakdown in operation.

The basic purpose of the invention is to construct a machine of the above-mentioned type in such a manner that it is assured that bristle holding sleeves which are free of bristles when they are pressed into the bristle magazine. Through a further development of the invention, a further improvement of the operating efficiency is achieved by preventing the repeated movement of a finished brush into the welding station.

The inventive machine of the above-mentioned type is characterized by a discharge station in which ejectors are pushed through the hollow bristle holding sleeves during forward movement of the bristle bunch holder.

In the inventive machine, the bristle bunch holder is emptied precautionarily by pushing ejector pins through the bristle holding sleeves. During a trouble-free operation, this ejection procedure has no importance. However, if bristles remain in the bristle holding sleeves, these are pushed out of the sleeves so that during the following pressing of the bristle holding sleeves into the bristle magazine a smooth reception of the bristle bunches is assured. This cnsiderably improves the operating efficiency of the machine. Also material losses are avoided, which are caused by a disorderly array of bristles in the bristle magazine. The performance of the machine is, as a result and as a whole, considerably improved.

A machine with four bristle bunch holders is preferable. A larger number of bristle bunch holders hardly brings about any advantages. Each bristle bunch holder is then during each working cycle of the machine in one of the four stations, of which one is the inventively provided ejector or discharge station.

Ejectors are preferably associated with each bristle bunch holder. However, embodiments also fall within the scope of the invention, in which the ejectors are stationarily arranged and engage only in the discharge station the bristle holding sleeves. This embodiment has, however, the advantage that the problem of threading of the ejectors into the bristle holding sleeves does not exist.

With the further development of the invention, one achieves a substantial further increase in the performance of the machine. Namely, it is now possible to absorb in the magazine very many brush heads so that one operator will be able to operate several machines. This is made possible also particularly by the fact that attention must no longer be paid to the timely removal of finished brushes, because these are ejected automatically.

Further special characteristics, aside from the base in the discharge station which can be retracted, one could also use different removing means. For example one could design the lower ends of the holding bars to be removable. A removable base, however, has the special advantage that the force of gravity is fully effective for the ejecting operation, so that special ejecting means are not needed.

In place of the movement device, it could also be possible to provide for example a control cam, which operates the lever.

BRIEF DESCRIPTION OF THE DRAWINGS

The inventive machine is schematically illustrated in the drawings, in which.

DETAILED DESCRIPTION

Figure 1:
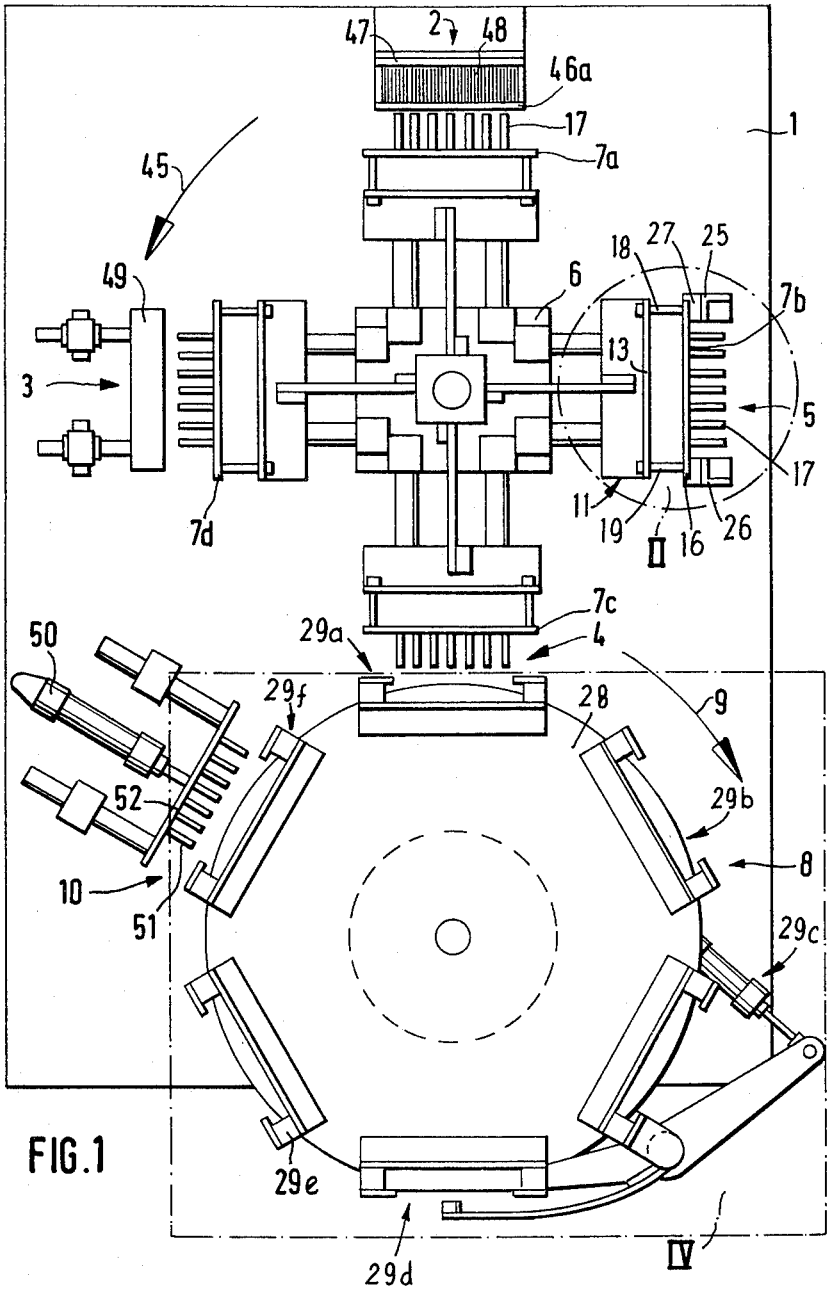
FIG. 1 is a top view of a machine having four bristle bunch holders.

The machine which is shown as a whole in FIG. 1 has a table 1, which is mounted on a frame (not visble) and which is preferably positioned at a comfortable working height. Four work stations are provided on the table and are each offset from one another at 90°. More specifically, the four work stations include a bristle receiving station 2, a bristle melting station 3, a welding station 4 and a discharge station 5. Relative to the stationary table 1 there is arranged a rotatable carrier which is identified as a whole by the reference numeral 6 in FIG. 1, on which carrier is mounted the four bristle bunch holders 7*a* to 7*d*.

A rotatable magazine which is identified as a whole by the reference numeral 8 is provided adjacent the table 1, which magazine can be rotated step-by-step in direction of the arrow 9. A melting station 10 cooperates with the rotatable magazine 6. The magazine 6 moves the brush heads 33 into the welding station 4, after they have passed through the melting station 10.

The structure of the bristle bunch holders 7*a* to 7*d* will be first described hereinbelow with reference to FIGS. 2 and 3.

The bristle bunch holder 7*b* (the bristle bunch holders 7*a*, 7*c* and 7*d* are constructed identical thereto) is mounted on a carriage 11. The carriage 11 has an angular member 11*a* thereon, to which is secured sleeves 11*b* and 11*c* which are slidable along a guide rod 12 received therein. Further sleeves, which are covered up in FIG. 3, are arranged parallel to the sleeves 11*b* and 11*c* on the member 11, which sleeves slide on a further guide rod 12.

A plate 13 is secured on a vertical part 11'*a* of the member 11*a*. Several ejector pins 15 are secured to the plate 13. Four horizontal rows 14*a* to 14*d* of such ejector pins 15 are provided in the illustrated embodiment. Each row contains eight ejector pins 15, as one can recognize from FIG. 2. The number of the pins 15 equals the number of bunches of bristles, which are to be secured on one brush.

A bristle bunch holder plate 16 is arranged parallel with the plate 13, which plate has hollow bristle holding sleeves 17 thereon. The bristle holding sleeves 17 are arranged in the same manner as the ejector pins 15. One ejector pin 15 each is received in a bristle holding sleeve 17.

Two guide rods 18 and 19 are secured to the plate 16, which rods extend through guide openings 13*a* in the plate 13, however, project a finite distance beyond the back side of the plate 13. A ring 20 is arranged at the end of each guide rod, from which ring projects a bolt 21. One end of a tension spring 22 is secured to the bolt 21. The other end of the tension spring engages a spring-anchoring part 23 fixedly connected to the plate 13.

As one can easily recognize from the drawings, the tension springs 22 urge the guide rods 18 and 19 and thus also the plate 16 with its bristle holding sleeves 17 to the left. The movement to the left, however, is limited by screwheads 24*a* of screws 24 engaging the plate 13. A screw 24 is arranged on each corner of the rectangular plate 16, which screw has a threaded part 24*b* threadedly coupled to an internally threaded opening in each of the four corners of the plate 16. The spacing of the plate 16 from the plate 13 and thus the depth of penetration of the ejector pins 15 into the bristle holding sleeves 17 can be precisely adjusted by turning the screws 24 into or out of the plate 16. Locking or set-screws 55 are used to fix the screws to the plate 16.

Two stop columns 25 and 26 are secured to the table 1 in the discharge station 5. The stop columns consist of angled sections welded to base plates 27 and which in turn are secured to the table 1. The stop columns 25 and 26 are, as one can see from FIG. 3, sufficiently high that they extend to the upper edge of the plate 16. The columns are laterally spaced from one another such that only the lateral edges of the plate 16 contact the columns.

Figure 2:
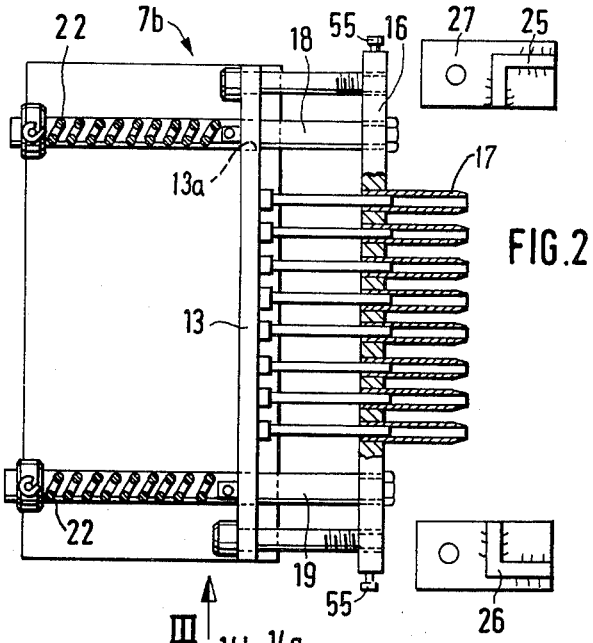
FIG. 2 is an enlarged section of the area in the dash-dotted circle II in FIG. 1.
Figure 3:
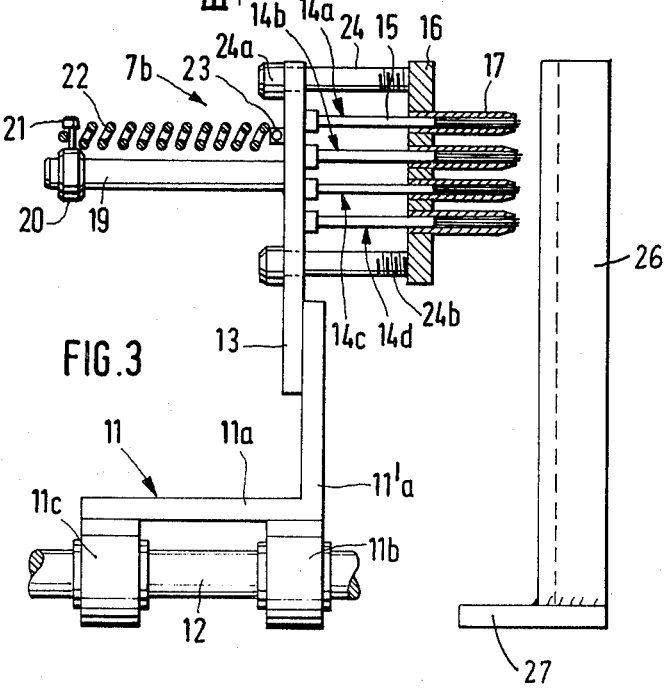
FIG. 3 is a view in direction of the arrow III in FIG. 2.

FIGS. 2 and 3 illustrate a condition in which the bristle bunch holder 7*b* is in its most retracted position. The carrier 6 can be moved radially on the guide rods 12 relative to the table 1. However, the guide rods 12 are not fixedly arranged on the table, but are parts of a rotatable carrier for the bristle bunch holders 7*a* to 7*d*.

If the bristle bunch holder 7*b* is now moved radially outwardly simultaneously with all other bristle bunch holders, the plate 16 will engage the columns 25 and 26. The outward movement of the carriage 11 is continued, whereby the plate 13 approaches the plate 16 under the tension of the springs 22. The plate 13 is moved against the now stopped plate 16 until the ejector pins 15 have been pushed completely through the bristle holding sleeves 17. This causes an ejection of possible residues, thus bristles, which are in the bristle holding sleeves 17 therefrom.

The structure and function of the magazine 8 will be discussed hereinbelow with reference to FIGS. 4 and 5.

The magazine 8 has a rotatable carrier plate 28 on which all together six stands 29*a* to 29*f* are arranged. Each of the stands has a base 30 for facilitating a fastening to the rotatable plate carrier 28. Two U-shaped profiles 31 and 32 are provided on each stand, which U profiles have grooves 31*a* and 32*a* for the engagement of the lateral edges of the brush heads 33.

A stationary plate 34 is arranged below the rotatably supported plate carrier 28, on which the stands 29*a* to 29*f* are secured. The stationary plate 34 forms the base for the magazines 29, in the area of which the upper plate 28 is cut out. The lower plate 34 also has a notch 34*a* at one location, which notch is partly filled out by a base part 35.

The base part 35 is fixedly connected to a lever arm 36*a* of a two-arm lever which is identified as a whole by the reference numeral 36. The lever 36 is rotatably supported as at 38 on a bracket 37. The piston rod 39*a* of a cylinder 39 is connected to the other arm 36*b* of the lever and the body of the cylinder 39*b* of the cylinder 39 is hingedly connected to a stationary bracket 40.

From viewing the drawing, it will be clear that an urging, under fluid pressure from any convenient source, of the piston rod 39*a* out of the cylinder body 39*b*, the lever 36 will be pivoted in a clockwise direction and the base part 35 will be swung farther into the notch 34*a* and thus no longer form a bse or support for the magazine 29*d*, so that the respectively lowermost brush head 33 can fall out.

In order that the brush heads, which are stacked one on top of the other, do not also fall out, the device which will be described hereinbelow is provided.

An upstanding pipe 41 is rigidly connected (as by welding) to the lever 36. The pipe has a radially extending rigid shoulder 42. A leaf spring 43 is secured to the shoulder 42, on the front or free end of which leaf spring is arranged a pressure piece 44.

Figure 5:
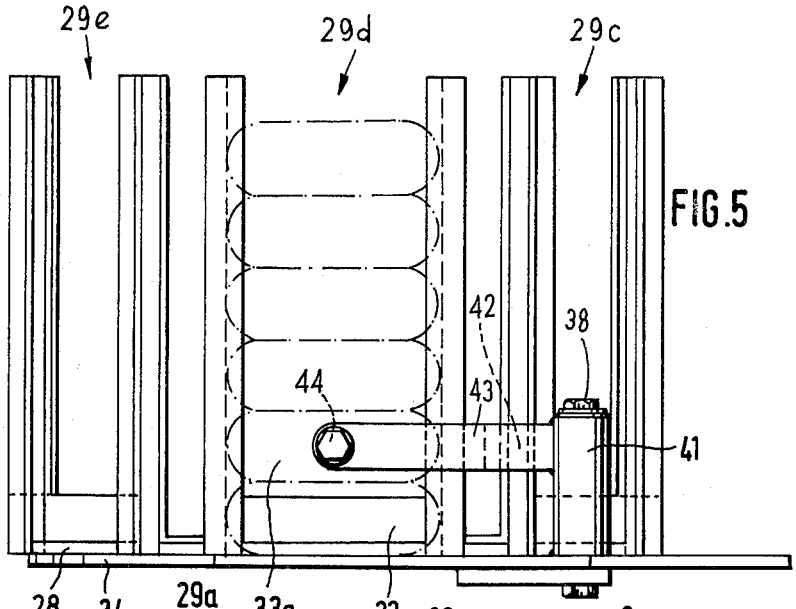
FIG. 5 is a view in direction of the arrow V in FIG. 4.
Figure 4:
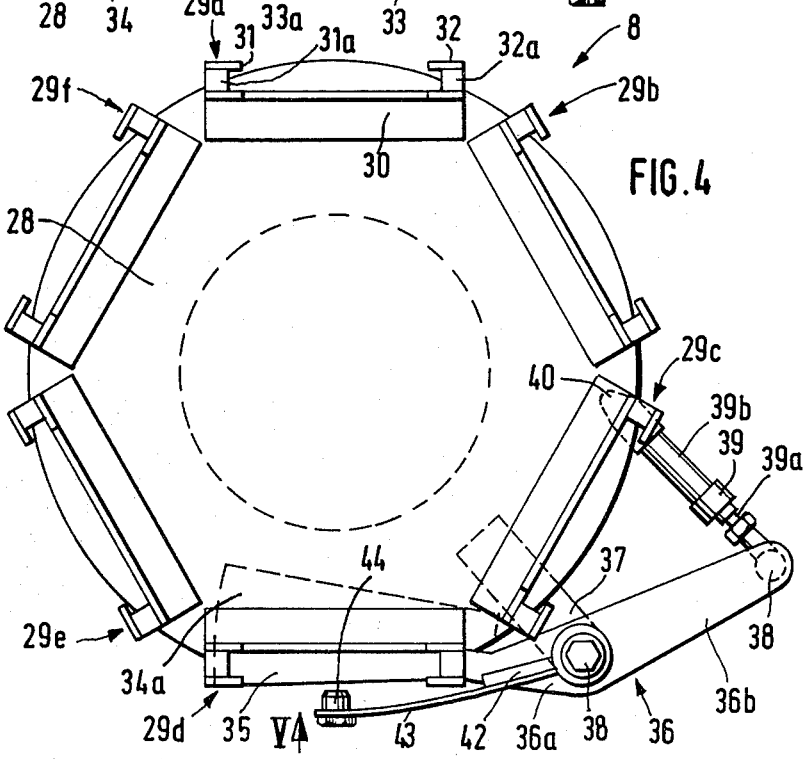
FIG. 4 is an enlarged section of the area in the dash-dotted frame IV in FIG. 1.

It will be readily recognized from FIG. 4 that when the lever 36 is swung in a clockwise direction, the pressure piece 44 will engage the brush head 33*a* (see here also FIG. 5). This contact is created prior to the base part 35 having been swung away from the area of the magazine. Thus the brush head 33*a* which is not as yet equipped with bristles is prevented from falling out, when the base part 35 is being swung away, so that all brush heads which are stacked thereabove are prevented from slipping downwardly through the notch 34*a*. When the lever 36 is again swung back into the illustrated position, the pressure piece 44 lifts off from the brush head 33*a* and the stack of brush heads can slide downwardly until the now lowermost brush head 33*a* rests on the base part 35.

OPERATION

The operation of the whole machine will be briefly discussed hereinbelow.

The rotation of the carrier 6 for the bristle bunch holders is coordinated with the rotation of the magazine 8, namely during a 90° rotation of the carrier 6, the magazine 8 carries out a 60° rotation. The carrier 6 rotates in a clockwise direction corresponding with the arrow 45, while the magazine, as already mentioned, rotates also in clockwise direction corresponding with the arrow 9. The path of the bristle bunch holders 7*a* will be viewed hereinbelow. The bristle bunch holder 7*a* is moved radially outwardly from the illustrated position, whereby its bristle holding sleeves 17 extend through holes in a vertical wall 46*a* of a bristle magazine 47 and are each filled up with bristles 48 initially packed in the magazine 47. Not illustrated vibration devices are utilized to cause the bristles 48 to be packed compactly in the bristle magazine and cavities which are created through removal of bristles are again quickly filled in. By pulling back the bristle holder 7*a*, same moves to the location at which the bristle holder 7*d* is located in FIG. 1. A heated plate 49 is provided in the melting station 3. The bristle bunches, which project slightly from the ends of the bristle holding sleeves 17, are pressed against the plate, whereby they are melted and become bonded together.

Simultaneously with the melting of the ends of the bristle bunches, the heating plate 52 which has heating rods 51 thereon is moved radially by means of a pneumatic cylinder 50, whereby the heating rods 51 are pressed against the lowermost brush head in the magazine 29*f*. The heating rods 51 are arranged in the same pattern as the bristle holding sleeves 17 so that the brush head is melted at every location corresponding to the connection location of a bristle bunch.

Simultaneously with the movement of the bristle bunch holder into the welding station 4, the magazine 8 moves through one rotary step, so that the brush head, portions of which have been melted, arrives in the welding station 4. When the partially melted brush head and the bristle bunch holder, which is filled with bristles, the end of which have been melted together, stand opposite one another the bristle bunch holder is moved radially to press the still pasty or tacky ends of the bristle bunches onto the still pasty or tacky melted locations in the brush head, whereby a fixed welding between the bristle bunches and the brush head is created. A retraction of the bristle bunch holder away from the brush head will cause the bristles to remain with the brush head and be pulled from the bristle holding sleeves. The time required to effect the welding is controlled by the period of cyclic operation of the carrier 6 and magazine 8.

After three further working cycles, the finished brush moves above the movable magazine base 35 and is there, as already described, discharged through the notch 34*a*.

After a further rotation of the carrier 6, the bristle bunch holder 7*a* arrives in the position corresponding to the position of the bristle bunch holder 7*b* in FIG. 1. During a forward or radially outward movement of the bristle bunch holder (all four bristle bunch holders are moved radially outwardly at the same time by means of a common not illustrated movement mechanism), the discharge operation which has already been described with reference to FIGS. 2 and 3 takes place.

Both the precautionary emptying of the bristle holding sleeves and also the magazine 8 with its automatic ejection device each by themselves considerably increase the operating safety and output of the machine. In particular the combination of these two improvements brings about a very considerable increase in efficiency.

In comparison with a magazine having six receiving means for individual brush heads, which must be inserted and removed by hand, there exists, aside from the substantially increased capacity of the magazine and thus the need to fill same only at relatively large spans, also a smaller susceptibility to trouble since it cannot happen that an already finished brush is again moved into the welding station. If a magazine is totally empty, then this has the consequence that the bristle bunches will be ejected in the discharge station 5.

Although a particular preferred embodiment of the invention has been disclosed in detail for illustrative purposes, it will be recognized that variations or modifications of the disclosed aparatus, including the rearrangement of parts, lie within the scope of the present invention.

The embodiments of the invention in which an exclusive propery or privilege is claimed are defined as follows:

1. In a machine for the manufacture of brushes, comprising a series arrangement of a bristle collecting station, a melting station and a welding station, and at least one bristle bunch holder, which consists of a plate having plural hollow bristle holding sleeves thereon and comprising movement devices, with which said bristle bunch holder is successively aligned with each of said stations, the improvement comprising ejector means, a discharge station arranged in said series arrangement and preceding said bristle collecting station, said discharge station having ejector activating means for effecting, during advancement of said bristle bunch holder, a movement of said ejector means through all of said bristle holding sleeves to eject all bristle material that may be lodged therein prior to the arrival of said bristle bunch holder at said bristle collecting station, a magazine arranged in said welding station, said magazine having at least one stand with holding bars for holding a stacked array of brush heads, a removing station in which is provided a holder for the second to the lowermost brush head, and removing means for the lowermost brush head, which has bristles secured thereto.

2. The machine according to claim 1, including a rotatable carrier, on which four bristle bunch holders are arranged, wherein said stations are angularly spaced at a distance of 90° and wherein each indexed step of the carrier is 90°.

3. The machine according to claim 1, wherein said ejector means is associated with said bristle bunch holder, said ejector means being operatively received in said bristle holding sleeves during all operating conditions, however, when outside of said discharge station fill only a portion of the length of said bristle holding sleeves.

4. The machine according to claim 3, wherein parallel with each plate there is arranged an ejector plate which has said ejector means thereon and wherein said plate is movable relative to said ejector plate at a right angle with respect to the planes of said plate and said ejector plate.

5. The machine according to claim 4, wherein stops for the contact of said plate are arranged in said discharge station and wherein said ejector plate is movable against an elastic restoring force after contact of said plate on said stops.

6. The machine according to claim 5, wherein guide rods are secured on said plate, which guide rods extend through guide openings in said ejector plate and on which tension springs engage, which tension springs are anchored to said ejector plate.

7. The machine according to claim 3, including adjustable screw stops having heads thereon for determining the spacing between said plate and said ejector plate, said heads of said adjustable stops engaging one of said ejector plate and said plate and are screwed into the other of said ejector plate and said plate.

8. The machine according to claim 1, wherein said magazine is a step-by-step rotatable magazine.

9. The machine according to claim 8, wherein said removing means has a base for supporting the lowermost brush head, which base can be retracted.

10. The machine according to claim 9, wherein said stand is supported on a platelike carrier and has therebelow a stationary plate forming a base for supporting the lowermost brush head of said stand and wherein a plate opening is provided in said removing station, which opening is at least partly filled by a movable base part movable into a position by a movement thereof in the plane of said stationary plate into a free area of the plate opening, whereat said movable base part becomes disengaged from the lowermost brush head.

11. The machine according to claim 10, wherein said movable base part is secured to a swingable lever, on which is engaged a pneumatic cylinder.

12. The machine according to one of the claims 1, 9, 10 or 11, wherein said holder is a pressure piece, which can be moved toward and away from the second to the uppermost brush head.

13. The machine according to claim 12, wherein said pressure piece is resiliently flexibly connected to said lever and is arranged such that it contacts the second to the lowermost brush head prior to the movable base part being pulled away.

14. The machine according to claim 13, wherein said pressure piece is secured on a leaf spring which is connected to said lever.

15. The machine according to one of the claims 10 to 11, wherein plural stands for receiving stacks of brush heads are arranged on said carrier.

* * * * *